US009653239B2

(12) United States Patent
Ono et al.

(10) Patent No.: US 9,653,239 B2
(45) Date of Patent: May 16, 2017

(54) WEAR-RESISTANT MATERIAL, METHOD FOR PRODUCING THE SAME, PUFFER CYLINDER AND PUFFER-TYPE GAS CIRCUIT BREAKER

(71) Applicant: Hitachi, Ltd., Chiyoda-ku, Tokyo (JP)

(72) Inventors: Masahiko Ono, Tokyo (JP); Makoto Hirose, Tokyo (JP); Daisuke Ebisawa, Tokyo (JP); Hisashi Urasaki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 86 days.

(21) Appl. No.: 14/335,465

(22) Filed: Jul. 18, 2014

(65) Prior Publication Data

US 2015/0060408 A1 Mar. 5, 2015

(30) Foreign Application Priority Data

Aug. 30, 2013 (JP) ..... 2013-178973

(51) Int. Cl.
*H01H 11/00* (2006.01)
*H01H 33/91* (2006.01)
*C23C 22/66* (2006.01)

(52) U.S. Cl.
CPC ..... *H01H 33/91* (2013.01); *C23C 22/66* (2013.01); *H01H 11/00* (2013.01); *Y10T 428/24355* (2015.01); *Y10T 428/24612* (2015.01)

(58) Field of Classification Search
CPC ..... H01H 2033/888; H01H 33/703; H01H 33/901
See application file for complete search history.

(56) References Cited

U.S. PATENT DOCUMENTS 3,506,799 A * 4/1970 Ellsworth ..... H01H 9/342 200/306
3,664,888 A * 5/1972 Oga ..... B05D 1/32 148/272

(Continued)

FOREIGN PATENT DOCUMENTS

CN 101669181 A 3/2010
CN 102612572 A 7/2012

(Continued)

OTHER PUBLICATIONS

U.S. Appl. No. 14/306,483, filed Jun. 17, 2014.

(Continued)

*Primary Examiner* — Truc Nguyen
(74) *Attorney, Agent, or Firm* — Crowell & Moring LLP

(57) ABSTRACT

The present invention includes a wear-resistant material including: a base material formed of pure aluminum or an aluminum alloy having a projection, and a depression in a pit-like shape on a surface thereof; and a coat including a dehydrate of a hydrated oxide of aluminum, the coat being formed on a surface of the base material. Further, the present invention including a method for producing a wear-resistant material including the steps of: forming a hydrated oxide coat of aluminum on a surface of the base material by a chemical conversion coating; and heating the hydrated oxide coat. Further, the present invention also includes a puffer cylinder and a puffer-type gas circuit breaker applied to the above wear-resistant material.

14 Claims, 5 Drawing Sheets

(56) References Cited

U.S. PATENT DOCUMENTS

| | | | | |
|---|---|---|---|---|
| 2007/0221626 | A1 | 9/2007 | Uchii | |
| 2009/0311577 | A1* | 12/2009 | Washima | C25D 11/18 429/406 |
| 2010/0147804 | A1 | 6/2010 | Yamada et al. | |
| 2012/0231281 | A1 | 9/2012 | Hirai et al. | |
| 2014/0367360 | A1* | 12/2014 | Ono | C23C 22/68 218/61 |

FOREIGN PATENT DOCUMENTS

| | | | |
|---|---|---|---|
| JP | 174738 | | 3/1947 |
| JP | 47-6083 | B | 2/1972 |
| JP | 47-6084 | B | 2/1972 |
| JP | 51-106646 | A | 9/1976 |
| JP | 52-120364 | A | 10/1977 |
| JP | 53-16857 | A | 2/1978 |
| JP | 63-184223 | A | 7/1988 |
| JP | 2-99172 | A | 4/1990 |
| JP | 2003-13253 | A | 1/2003 |
| JP | 2004-277784 | A | 10/2004 |
| JP | 2007-100201 | A | 4/2007 |
| JP | 2007-258137 | A | 10/2007 |
| JP | 2008-277014 | A | 11/2008 |

OTHER PUBLICATIONS

Chinese First Office Action issued in corresponding Chinese Application No. 201410336198.0 dated Mar. 24, 2016 with English translations (20 pages).

Chinese Second Office Action issued in corresponding Chinese Application No. 201410336198.0 dated Oct. 20, 2016 with English translations (22 pages).

Chinese publication from www.cip.com.cn dated Apr. 30, 2010 with partial English translations (19 pages).

Japanese Office Action issued in counterpart Japanese Application No. 2013-178973 dated Nov. 22, 2016 with English translation (five pages).

* cited by examiner

WEAR-RESISTANT MATERIAL, METHOD FOR PRODUCING THE SAME, PUFFER CYLINDER AND PUFFER-TYPE GAS CIRCUIT BREAKER

CLAIM OF PRIORITY

The present application claims priority from Japanese patent application serial No. 2013-178973 filed on Aug. 30, 2013, the content of which is hereby incorporated by reference into this application.

BACKGROUND OF THE INVENTION

1. Field of the Invention

The invention relates to a wear-resistant material and a method for producing the same, a puffer cylinder and a puffer-type gas circuit breaker, and in particular, to a wear-resistant material, suitable for use in one formed of pure aluminum or an aluminum alloy.

2. Description of the Related Art

In general, aluminum or an aluminum alloy for use in a slide member is material susceptible to wear due to a sliding-movement, and therefore, application of the alumite treatment, a plating treatment, or a variety of coatings thereto is well known.

A puffer-type gas circuit breaker for electric power represents an example of an apparatus using aluminum or an aluminum alloy as a slide member. The puffer-type gas circuit breaker for electric power includes a stationary contactor, a movable contactor arranged capable of contacting with and separating from the stationary contactor, a puffer cylinder linked with the movable contactor, a piston making a relative movement against an inner-wall surface of the puffer cylinder, a puffer chamber having a suction hole for sucking in the arc-extinguishable gas and a blast nozzle for spurting the same in the direction of the contactor, a wearing slidably-movable against the inner-wall surface of the puffer cylinder, provided on the outer periphery of the piston a vessel filled up with an arc-extinguishable gas which houses the above components, and the puffer-type gas circuit breaker being made up such that the arc-extinguishable gas that is spurted from the blast nozzle is sprayed to an arc generated upon the stationary contactor and the movable contactor coming in contact with, or separating from each other to thereby extinguish the arc.

With the puffer-type gas circuit breaker made up as described above, pure aluminum or an aluminum alloy is often used in the puffer cylinder for the purpose of reduction in weight. However, pure aluminum or an aluminum alloy is a material which is susceptible to wear, as described above. Thus, a variety of surface treatments are applied at times to a slide member in order to prevent the wear of the slidably-movable part.

For example, there is described a technique in Patent Document 1 (Japanese Unexamined Patent Application Publication No. S63(1988)-184223), as a technique for enhancement of the wear-resistance of aluminum or an aluminum alloy. In this publication, it is described that a puffer cylinder, an operation rod, and a presser plate are each formed of aluminum or an aluminum alloy, and the coat of aluminum oxide, formed by the alumite treatment, is provided on respective portions of these components, coming in contact with each other.

Further, in Patent Document 2 (Japanese Unexamined Patent Application Publication No. 2008-277014), it is described that a coating layer of an amorphous carbon or a diamond-like carbon, as material that is wear-resistant and low in frictional properties, is formed on a slidable surface, which slidably moves against a seal-rod, of a seal-member made of a synthetic rubber or fluororesin, for slidably supporting the seal-rod at a penetration part of a gas vessel to thereby prevent an arc-extinguishable gas in the gas vessel from flowing out towards a manipulation-mechanism.

Still further, in Patent Document 3 (Japanese Unexamined Patent Application Publication No. 2007-258137), it is described that a silicone grease having lubricity is applied to the outer peripheral surface of a cylinder that slidably moves at the time when a stationary arc-contactor comes in contact with, or separates from a movable arc-contactor in order to reduce friction.

However, with the technique disclosed in Patent Document 1 described as above, in order to enhance wear resistance of aluminum or an aluminum alloy, the alumite treatment is applied to the respective portions of the puffer cylinder, the operation rod, and the presser plate, coming in contact with each other, and although an alumite coat formed by the alumite treatment is excellent in corrosion resistance and wear resistance, anodic oxidation is required in the alumite treatment, so that the cost of electric power required by facilities will increase, and in the case of using sulfuric acid, facilities for waste-water treatment will be required, thereby posing a cost problem.

Further, with the technique disclosed in Patent Document 2 described as above, the wear-resistance of a slide member is enhanced by coating with the material low in frictional properties such as the amorphous carbon or the diamond-like carbon, however, these being the coating formed by the high-frequency plasma CVD (Chemical Vapor Deposition) method, if the method is to be applied to a puffer cylinder, a vacuum apparatus having a capacity capable of processing the puffer cylinder will be required.

Still Further, in the case of the technique disclosed in Patent Document 3 described as above, because the silicone grease having lubricity is applied to the outer peripheral surface of the cylinder serving as the slidably-movable part, there is the need for taking degradation of the silicone grease into consideration if the silicone grease is in use for a long time-period, thereby necessitating periodical maintenance.

The present invention has been developed in view of those points described as above, and it is therefore an object of the invention to provide a wear-resistant material excellent in wear resistance, available at a low cost, a method producing the same, a puffer cylinder, and a puffer-type gas circuit breaker.

SUMMARY OF THE INVENTION

To that end, according to one aspect of the present invention, there is provided a wear-resistant material including: a base material formed of pure aluminum or an aluminum alloy having a projection, and a depression in a pit-like shape on a surface thereof; and a coat including a dehydrate of a hydrated oxide of aluminum, the coat being formed on a surface of the base material. As a sliding aspect of the wear-resistant material according to the present invention, a relationship between pure aluminum or an aluminum alloy and an opposing material may be any of rotation, swing, or reciprocating motion, including even a relationship as a composite of these motions.

To that end, according to another aspect of the present invention, there is provided a puffer cylinder formed of pure aluminum or an aluminum alloy being linked with a movable contactor which is arranged capable of contacting with and separating from a stationary contactor, fitted with a piston inside thereof, and the piston slidably moving against an inner-wall surface of the puffer cylinder in order for the piston to suck in, or spurt an arc-extinguishable gas, the puffer cylinder comprising: a projection, and a depression in a pit-like shape formed at least on the inner-wall surface thereof; and a coat including a dehydrate of a hydrated oxide of aluminum, the coat being formed on the projection, and the depression in a pit-like shape of the puffer cylinder.

To that end, according to still another aspect of the present invention, there is provided a puffer-type gas circuit breaker including: a stationary contactor; a movable contactor being arranged capable of contacting with and separating from the stationary contactor; a puffer cylinder being formed of pure aluminum or an aluminum alloy, the puffer cylinder being linked with the movable contactor; a piston for sucking in or spurting an arc-extinguishable gas while making a relative movement against an inner-wall surface of the puffer cylinder; and a vessel being filled up with the arc-extinguishable gas, the vessel housing the stationary contactor, the movable contactor, the puffer cylinder and the piston; wherein the puffer-type gas circuit breaker is configured such that the arc-extinguishable gas that is spurted as a result of the movement made by the piston is sprayed to an arc caused by a separation of the stationary contactor and the movable contactor to thereby extinguish the arc, and the puffer cylinder is the puffer cylinder of the present invention described above.

To that end, according to a further aspect of the present invention, there is provided a method for producing a wear-resistant material formed of pure aluminum or an aluminum alloy, the method comprising the steps of: preparing a base material formed of pure aluminum or an aluminum alloy; forming a hydrated oxide coat of aluminum on a surface of the base material by a chemical conversion coating, thereby forming a projection, and a depression in a pit-like shape on the surface of the base material; and heating the hydrated oxide coat, thereby removing the water content of a hydrate from the hydrated oxide coat and obtain a dehydrate coat of the hydrated oxide of aluminum.

The invention has advantageous effects in that a cost of a wear-resistant material can be lowered and excellent wear-resistance of a wear-resistant material can be achieved, while suppressing the abrasion-powders of pure aluminum or an aluminum alloy.

DETAILED DESCRIPTION OF THE PREFERRED EMBODIMENTS

A wear-resistant material, a method for producing the same, a puffer cylinder and a puffer-type gas circuit breaker according to the invention are described below on the basis of respective embodiments shown in the accompanying drawings.

First Embodiment

Figure 1:
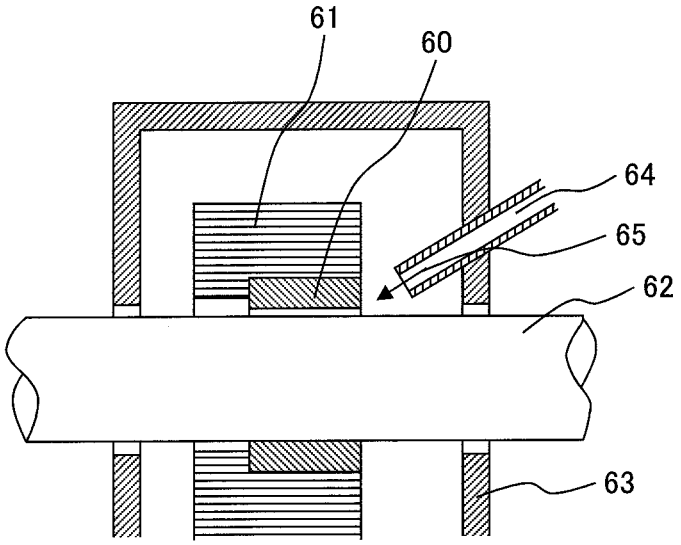
FIG. 1 is a schematic cross-sectional view of a first embodiment of the invention, showing a testing unit of a journal-type test apparatus to explain about applicability of the present invention to a wear-resistant material.

First, the wear-resistant material (the basic configuration (first embodiment)) of the present invention is described with reference to FIG. 1. FIG. 1 shows a schematic cross-sectional view of a testing unit of a journal-type test apparatus (note that a shaft 62 is not shown as cross-sectional view for convenience of explanation in FIG. 1 as well as 35 in FIGS. 2 and 3).

The testing unit of the journal-type test apparatus, shown in the FIG. 1, is made of a synthetic resin material containing PTFE (Poly Tetra Fluoro Ethylene) as a primary constituent, and the testing unit, serving as a bearing 60 cylindrical in shape, is pushed into a casing 61, thereby rotatably supporting a shaft 62. The casing 61 can add a load on the bearing 60. The shaft 62 is rotatably supported by a ball-and-roller bearing (not shown) provided on the respective sides of the shaft 62. Further, a rotational driving motor (not shown) is connected to one end of the shaft 62, and the testing unit is covered by a protective cover 63.

Pure aluminum was used for the shaft 62, and the shaft 62 was immersed in a boiled aqueous solution containing a small amount of ammonia for predetermined time to thereby form a hydrated oxide coat of aluminum on the surface of the shaft 62.

Figure 7:
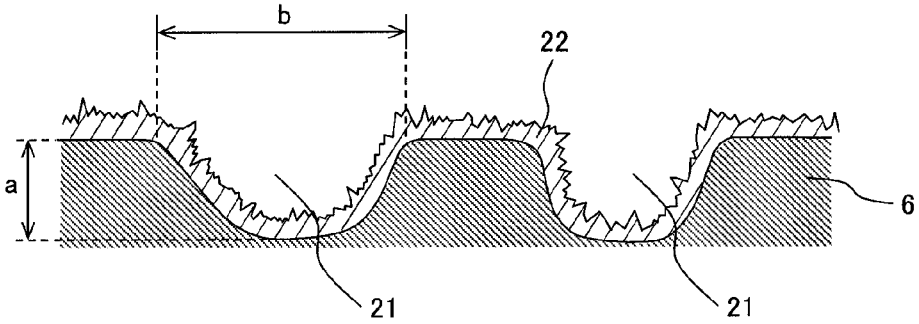
FIG. 7 is a schematic cross-sectional view showing an example of a sectional shape of the wear-resistant material according to the first embodiment of the present invention.
Figure 8:
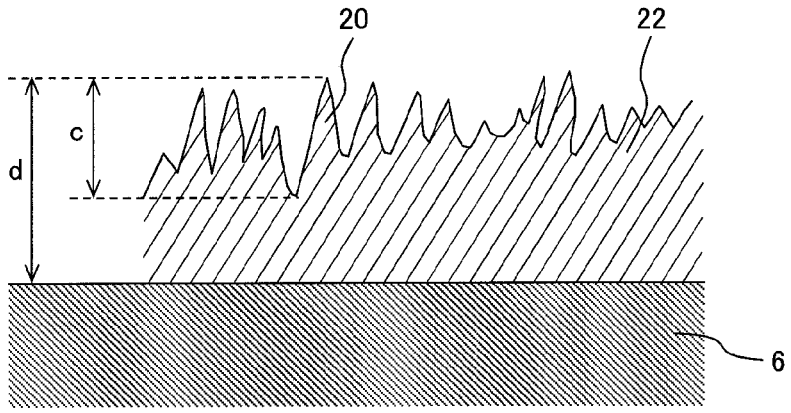
FIG. 8 is a schematic cross-sectional view showing a sectional shape of the wear-resistant material according to the first embodiment of the present invention.

By optimization of the above treatment time, a fine asperity structure was formed on the surface of the shaft 62 as shown in FIGS. 7 and 8. The surface of the shaft 62 formed of pure aluminum has a depression 21. The depth of the depression 21 (the length of "a" described in FIG. 7) is not less than 1 μm, preferably about 5 μm, in a pit-like shape or a crater-like shape. The diameter of the depression 21 (the length of "b" described in FIG. 7) is about from 5 to 30 μm. The depression 21 sometimes forms an aggregates and the diameter of the aggregates is about from 80 to 100 μm.

As described in FIGS. 7 and 8, a hydrated oxide coat of aluminum 22 was formed along the projections and depressions of the shaft 62. The hydrated oxide coat of aluminum 22 includes fine asperity structure which is finer than the fine asperity structure of the surface of the shaft 62. The hydrated oxide coat of aluminum 22 has a fine projection 20. The length of the projection 20 (the length of "c" described in FIG. 8) is not more than 1 μm, in a needle-like shape or a petal-like shape. The range of the thickness of the coat (the length of "d" described in FIG. 8) is preferably 1 to 3 μm. The thickness can be controlled by the treatment time.

The structure of the base material (puffer cylinder 6) having the hydrated oxide coat of aluminum obtained by a chemical conversion coating of the present invention differs from the structure of an alumite obtained by an anodic oxidation. Each of the base material (puffer cylinder 6) and the hydrated oxide coat of aluminum 22 of the present invention have a finely asperity structure. The respective depressions (crater) 21 have various sizes and are formed randomly on the base material in the present invention. In contrast, in the case of the alumite, micropores in a cylindrical shape are generally formed regularly on the surface thereof.

In this case, a skewness Sk of the surface of the shaft 62 was −1.2. The skewness SK is a parameter based on the JIS (Japanese Industrial Standards) B 0601:1994 (which corresponds Rsk based on the JIS B 0601:2013) and ISO (International Organization for Standardization) 4387:1997. If skewness is negative, this indicates that surface is smooth. If the skewness Sk is plus, this indicates that the surface is rough, thereby rendering an opposing material susceptible to wear. Thus, it is preferred that the skewness SK is a negative value because the wearing amount of opposite material can be reduced. According to an analysis of an X-ray diffractometer of the surface of the shaft 62, it was found that boehmite ($Al_2O_3.H_2O$) (hydrated oxide of aluminum) and bayerite ($Al(OH)_3$) were formed. A coat 22 of hydrated oxide of aluminum was formed in regions around the depression 21, as well, as shown in FIG. 7.

The shaft 62 formed of pure aluminum with the hydrated oxide coat of aluminum 22 formed thereon was placed in a heating furnace (not shown) to be heated to 450° C. The skewness was found unchanged even after heating, and the fine projection 20 in the needle-like shape or the petal-like shape, as well as the depression 21 in the pit-like shape or a crater-like shape remained just in as-formed state, however, the crystallization state of the surface was found $Al_2O_3$ according to analysis with the use of an X-ray diffraction system, indicating that the water content of the hydrate was lost (that is, a composition of the coat changes from the hydrated oxide of aluminum to a dehydrate of a hydrated oxide of aluminum). Further, a crack was formed on the coat of the dehydrate of a hydrated oxide of aluminum because of a contraction of the coat of hydrated oxide of aluminum.

At this time, it need only be sufficient to have a heating temperature at which the water content of the hydrate is lost, and a temperature not lower than 100° C., as the boiling point of water, will suffice (since the melting point of aluminum is 660° C., the upper limit of the heating temperature is preferably 600° C.). A temperature at which the water content of the hydrate is eliminated is measured preferably by use of a thermogravimetric analyzer (TGA), etc., and a temperature not lower than the measured temperature will suffice.

In FIG. 1, a through-hole 64 penetrating through the protective cover 63 is provided around the testing unit, and there is shown a gas flow 65 discharged from the through-hole 64.

As shown in FIG. 1, a nitrogen gas was fed from the through-hole 64 towards the vicinity of a slidably-movable part at a rate of 10 L/min. The rotational speed of the shaft was set at 1 to 3 mm/s. As a result, PTFE of the bearing 60 was found uniformly transferred to the surface of the shaft 62, and abnormal wear was not observed on the slidably-movable part even in an inert gas at 5 MPa of contact pressure.

More specifically, it can be said that an aluminum oxide coat formed thereon, produced by eliminating the water content of the hydrate from the hydrated oxide coat of aluminum 22, is effective as a wear-resistant material.

Further, in the case of an example described as above, pure aluminum was used for the shaft 62, however, the same effects can be obtained in the case of using an aluminum alloy instead of pure aluminum.

Second Embodiment

Figure 2:
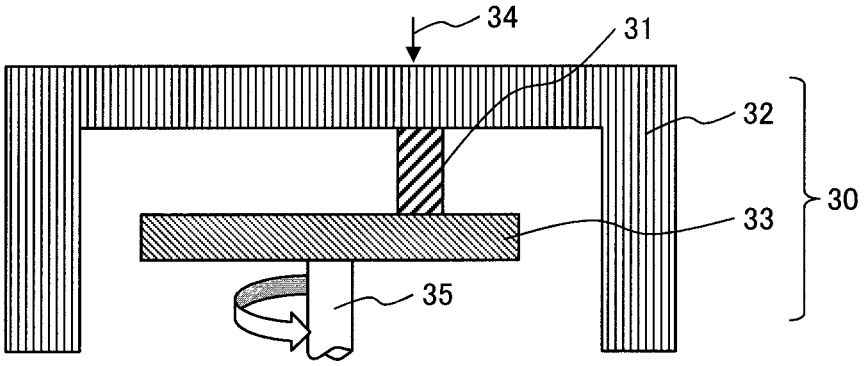
FIG. 2 is a schematic cross-sectional view of a second embodiment of the invention, showing a pin-on-disk type testing unit to explain about applicability of the present invention to a wear-resistant material.

Next, there is described a second embodiment of the invention, using a pin-on-disk type testing unit shown in FIG. 2.

As shown in FIG. 2, pure aluminum with a hydrated oxide coat of aluminum formed thereon was heated at 450° C. in the heating furnace (not shown) and cooled after the heating, to be used as a disk test-piece 33, in a disk-like shape, and a wearing material containing PTFE as a primary constituent, to be used as a pin-shaped test-piece 31 8 mm in diameter, both the disk test-piece 33, and the pin-shaped test-piece 31 were placed in a test apparatus 30, as is the case with the first embodiment. The skewness (Sk) of the disk test-piece 33 was −1.3. A press-down load 34 was applied to a slidably-movable part through the intermediary of a cover 32 under a test condition that the rotational speed of the disk test-piece 33 by a rotation axis 35 was set at 1 m/s.

As a result of this test, abnormal wear was not observed with respect to both the disk test-piece 33, and the pin-shaped test-piece 31 even at 9 MPa of contact pressure. In other words, it can be said that pure aluminum with aluminum oxide coat formed thereon, produced by eliminating the water content of a hydrate from the hydrated aluminum coat 22, is effective as a wear-resistant material in this slidably-movable state as well. Further, an example described as above is applicable even to the case of an aluminum alloy.

Third Embodiment

Figure 3:
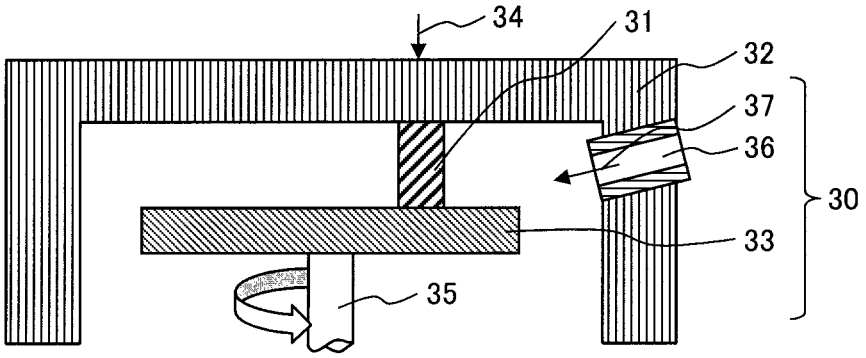
FIG. 3 is a schematic cross-sectional view of a third embodiment of the invention, showing a pin-on-disk type testing unit to explain about applicability of the present invention to a wear-resistant material.

Next, a third embodiment is described below. With the present embodiment, a test was conducted with the use of the test apparatus according to the second embodiment, except that a through-hole 36 was provided in the vicinity of the slidably-movable part, and a nitrogen gas 37 was fed through the through-hole 36 at a rate of 10 L/min, as shown in FIG. 3. Otherwise, the present test is the same as the preceding test (Second Embodiment).

As a result of this test, abnormal wear was not observed with respect to both the disk test-piece 33, and the pin-shaped test-piece 31 even in an inert gas at 9 MPa of contact pressure.

Thus, it is evident that if pure aluminum with a hydrated oxide coat of aluminum formed thereon is heated, wear resistance will be rendered excellent not only in the air but also in a nitrogen gas.

Fourth Embodiment

With the present embodiment, treatment for hydrated oxide coat of aluminum was applied to the disk test-piece 33 formed of pure aluminum, according to the second embodiment, by use of the same method as adopted in the first embodiment, before heating, and a PEEK (Poly Ether Ether Ketone) resin was used for the pin-shaped test-piece 31. Even though a sliding test was conducted with this combination, a conspicuous wear was not observed with respect to a slidably-movable part.

Fifth Embodiment

With the present embodiment, treatment for hydrated oxide coat of aluminum was applied to the disk test-piece 33 formed of pure aluminum, according to the second embodiment, by use of the same method as adopted in the first embodiment, before heating, and a polyacetal resin was used for the pin-shaped test-piece 31. Even though a sliding test was conducted with this combination, a conspicuous wear was not observed with respect to a slidably-movable part.

Sixth Embodiment

Next, an example in which a wear-resistant material formed of aluminum is applied to a puffer-type gas circuit breaker, referred to as a sixth embodiment of the invention, is described below with reference to FIGS. 4, and 5.

Figure 4:
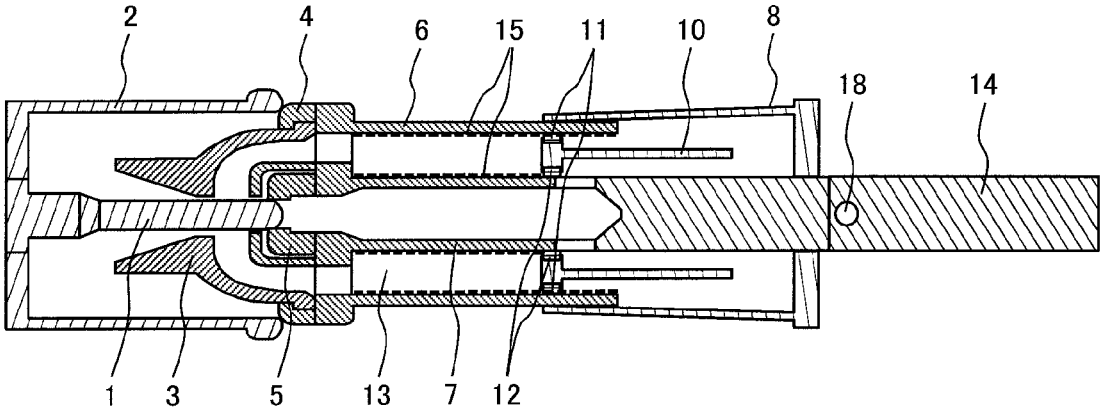
FIG. 4 is a schematic cross-sectional view of a sixth embodiment of a puffer-type gas circuit breaker according to the present invention, indicating a current-ON state.

FIG. 4 is a schematic cross-sectional view of a sixth embodiment of a puffer-type gas circuit breaker according to the invention, indicating a current-ON state.

With the puffer-type gas circuit breaker according to the present embodiment, a stationary-side current-carrying part is made up of a stationary-side arc-contactor 1, and a stationary-side main contactor 2 disposed outside the stationary-side arc-contactor 1, whereas a movable-side current-carrying part in contact with the stationary-side current-carrying part is made up of a movable-side arc-contactor 5, and a movable-side main contactor 4 disposed outside the movable-side arc-contactor 5, both the stationary-side current-carrying part, and the movable-side current-carrying part being fixed to a puffer cylinder 6, as shown in FIG. 4.

A cylinder shaft 7 is installed at a central part of the puffer cylinder 6, the cylinder shaft 7 is connected to an insulation-manipulation rod 14 via a link 18, and an operation for causing the current-ON state between the stationary-side current-carrying part, and the movable-side current-carrying part, or a current cut-off state therebetween is executed by driving the insulation-manipulation rod 14 through a manipulator (not shown). Further, an external current collector 8 is disposed on the outer periphery of the puffer cylinder 6, and the external current collector 8 is connected to a movable-side main circuit conductor (not shown) supported by an insulating tube (not shown).

Meanwhile, a piston 10 is fitted into the puffer cylinder 6, and a puffer chamber 13 that is surrounded by an inner surface of the puffer cylinder 6, an outer surface of the cylinder shaft 7, and the piston 10 is formed for the purpose of compressing an arc-extinguishable gas. The puffer cylinder 6 is formed of pure aluminum, and respective wearings 11, and 12, differing in diameter from each other, are provided on the outer periphery of the piston 10. As the piston 10 moves, the piston 10 slidably moves against the inner surface of the puffer cylinder 6, through the intermediary of the respective wearings 11, and 12, while slidably moving against the inner surface of the cylinder shaft 7.

Figure 5:
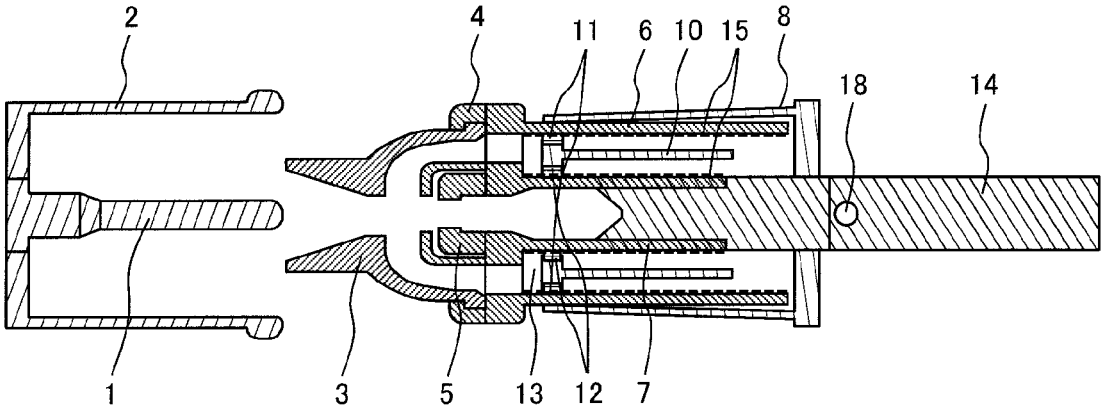
FIG. 5 is a schematic cross-sectional view of the sixth embodiment of a puffer-type gas circuit breaker according to the present invention, indicating a current cut-off state.

FIG. 5 indicates a state of the puffer-type gas circuit breaker at a time when a current cut-off operation is executed from the current-ON state shown in FIG. 4. At the time of the current cut-off operation, shown in FIG. 5, the puffer cylinder 6 makes a movement rightward in FIG. 5, and upon separating of the stationary-side arc-contactor 1 from the movable-side arc-contactor 5, as a result of this movement, the piston 10 is caused to move to thereby compress the arc-extinguishable gas such that the volume of the puffer chamber 13 is reduced, whereupon the arc-extinguishable gas from an insulation nozzle 3 is sprayed to an arc generated between the stationary-side arc-contactor 1 and the movable-side arc-contactor 5, so that the arc is extinguished.

With the puffer-type gas circuit breaker according to the present embodiment, made up as above, treatment for forming hydrated oxide coat of aluminum was applied to a range (indicated by reference sign 15) wider than every portion of the puffer cylinder 6, against which the respective wearings 11, and 12 slidably move. More specifically, there was applied the treatment for forming hydrated oxide coat of aluminum on a surface of the puffer cylinder 6 formed of pure aluminum, that is, the inner-wall surface thereof, against which the piston 10 slidably moves, by application of chemical conversion coating, such that the surface of the hydrated aluminum has a projection 20, and a depression 21, in a pit-like shape (or a crater-like shape), is formed on the surface.

As a treatment (chemical conversion coating) method for forming the hydrated oxide coat of aluminum, the puffer cylinder 6 subjected to degreasing after machining was immersed in pure water heated to 95° C. or higher for predetermined time.

The puffer cylinder 6 with the hydrated oxide coat of aluminum formed thereon was placed in a drying oven (not shown) to be heated to 450° C., whereupon the water content of a hydrate was removed from the hydrated oxide coat of aluminum. A fine projection 20 not more than 1 μm, in a needle-like shape or a petal-like shape, was formed on the surface, that is, the inner-wall surface of the puffer cylinder 6 after heating, just as before the heating, and a depression 21 not less than 1 μm, preferably about 5 μm, in a pit-like shape (or a crater-like shape), was confirmed. Upon analyzing this surface by use of an X-ray diffraction system, it was found that the surface was turned into aluminum oxide ($Al_2O_3$).

Figure 9:
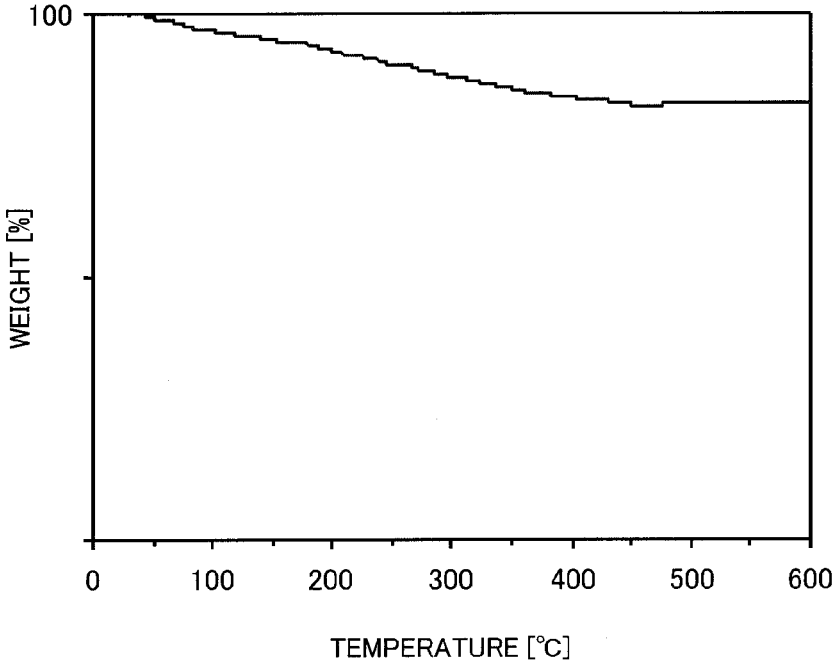
FIG. 9 is a graph showing a TGA curve of the hydrated oxide coat of aluminum of the present invention.

FIG. 9 is a graph showing a TGA curve of the hydrated oxide coat of aluminum of the present invention. The FIG. 9 shows the result of a test conducted in order to explain about the removal of the water content of a hydrate from hydrated oxide coat of aluminum by heating the puffer cylinder 6 with the hydrated oxide coat of aluminum formed thereon to 450° C. In the graph of FIG. 9, the horizontal axis indicates temperature (° C.), the vertical axis indicates weight (%), and the graph was prepared by applying the chemical conversion coating to the puffer cylinder 6 formed of pure aluminum to thereby form hydrated oxide coat of aluminum, and subsequently measuring variation (%) in weight of hydrated aluminum, while heating the hydrated aluminum thereafter.

As shown in the FIG. 9, since weight-variation was vanished at a point in the vicinity of 450° C., it can be understood that the water content of a hydrate was lost from the hydrated oxide coat of aluminum.

With the present embodiment, there is described an example in which the puffer cylinder 6 formed of pure aluminum was heated to 450° C., however, if the heating temperature is in a range of 100 to 600° C., as described above, this will suffice.

With the present embodiment described as above, if a coat including microscopic asperities, or the microscopic asperities, together with pits and projections, larger in size than the former, is formed on the puffer cylinder 6 formed of pure aluminum at a low cost, this will promote the transfer of the respective wearing materials 11, and 12, thereby enabling the abrasion-powders of aluminum to be suppressed, so that wear resistance is enhanced.

Further, with the embodiment described as above, there is described the case where pure aluminum was used in the puffer cylinder 6, however, even in the case of using an aluminum alloy, the same effects can be obtained (the same goes for embodiments described below).

Seventh Embodiment

Figure 6:
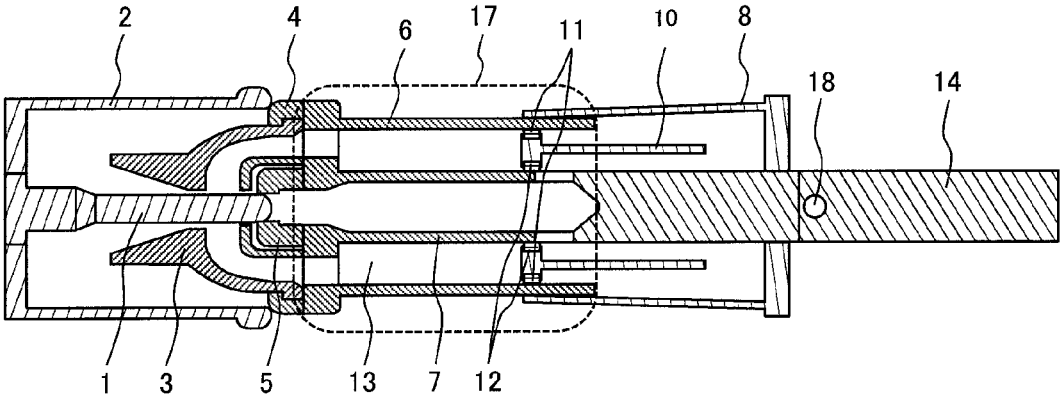
FIG. 6 is a schematic cross-sectional view of a seventh embodiment of a puffer-type gas circuit breaker according to the present invention, indicating a range where processing for hydrated aluminum is applied, this figure corresponding to FIG. 4.

FIG. 6 shows a seventh embodiment of a puffer-type gas circuit breaker according to the present invention. With the present embodiment shown in the FIG. 6, hydrated oxide coat of aluminum is formed throughout the whole 17 of a puffer cylinder 6 (that is, the hydrated oxide coat of aluminum is formed on the outer surface of the puffer cylinder 6 as well as the inner surface thereof), and subsequently, heating is applied thereto. The treatment condition is the same as adopted in the sixth embodiment.

With the embodiment described as above, the same effects as those in the case of the sixth embodiment can be obtained.

Eight Embodiment

With the present embodiment, hydrated alumina is formed on a puffer cylinder 6 by use of an aqueous solution obtained by addition of a small amount of ethanolamine to the pure water used in the sixth embodiment.

With the embodiment described as above, needless to say, not only the same effects as those in the case of the sixth embodiment can be obtained but also a time length for immersion of the puffer cylinder 6 in the aqueous solution heated to 95° C. or higher can be shortened. The water content of the hydrate was removed by heating the puffer cylinder 6 after formation of the hydrated oxide coat of aluminum, as with the case of the sixth embodiment.

Further, with the present embodiment, ethanolamine was used, however, besides other additives described below may be used. That is, carbonate, oxalate, triethanolamine, hydrazine or solute of seawater. Further, the treatment water may contain mixture of magnesium ion and hydrogen carbonate ion, mixture of magnesium ion, mixture of hydrogen carbonate ion and sulfide ion, mixture of hydroxide ion and lithium ion, mixture of hydroxide ion and sodium ion (sodium hydroxide), mixture of hydroxide ion and potassium ion (potassium hydroxide) hydroxide ion, mixture of lithium ion and silicate ion, mixture of hydroxide ion and calcium ion, hydroxide ion, or mixture of lithium ion and nitrate ion, mixture of hydroxide or sulfate, for example.

Ninth Embodiment

With the present embodiment, the treatment for forming hydrated oxide coat of aluminum on a puffer cylinder 6, as in the case of the sixth embodiment, and treatment time is rendered longer than that in the case of the sixth embodiment. In this embodiment, the skewness Sk was −0.3, the depression 21 in the pit-like shape was in a range of 2 to 5 μm, and it was found that boehmite and bayerite were formed, as is the case with the sixth embodiment. The water content of the hydrated oxide coat of aluminum was removed by heating this puffer cylinder 6, as is the case with the sixth embodiment. It was found that microscopic asperities in a needle-like shape or a petal-like shape, and a depression 21 in a pit-like shape were formed on the surface of the puffer cylinder 6 after heating, that is, the inner-wall surface thereof, in the same fashion as before the heating.

With the present embodiment described as above, the same effects as those in the case of the sixth embodiment can be obtained.

Comparative Example 1

As Comparative Example 1, use was made of a puffer cylinder on which hydrated oxide coat of aluminum is formed by shortening treatment time for immersion of the puffer cylinder in pure water heated to not lower than 95° C., a temperature above that in the case of the sixth embodiment, was heated to 450° C. In this case, the skewness Sk was −0.9.

Comparative Example 2

As Comparative Example 2, non-treated aluminum alloy (which is not applied a chemical conversion) was used. In this case, the skewness Sk was at −0.03.

The puffer cylinder according to each of the embodiments 6 through 9, and Comparative Examples 1, 2 is assembled into a gas circuit breaker to thereby conduct a sliding test. The primary constituent of the opposing material was PTFE, and use was made of a wearing that does not contain filler such as glass, etc. The results of the test are shown in Table 1.

TABLE 1

| | wear resistance | |
|---|---|---|
| | Puffer cylinder | Wearing |
| Sixth Embodiment | Extremely small Wear | Extremely small Wear |
| Seventh Embodiment | Extremely small Wear | Extremely small Wear |
| Eighth Embodiment | Extremely small Wear | Extremely small Wear |
| Ninth Embodiment | Extremely small Wear | slightly worn |
| Comparative Example 1 | Worn | Worn |
| Comparative Example 2 | Worn | Worn |

With the embodiments 6 through 8, abnormal wear was not observed with respect to both the puffer cylinder 6, and the respective wearings 11, and 12, as is evident from Table 1. With the embodiment 9, abnormal wear was not found on the puffer cylinder 6, however, the respective wearings 11, and 12 were found slightly worn, as compared with the embodiment 6. This is due to deterioration in surface smoothness from the sixth embodiment because the skewness has become bigger.

Upon observation of the slidably-movable part with respect to the respective embodiments, it was confirmed that PTFE has been transferred into microscopic asperities as well as a deep depression, in the pit-like shape, on the surface of the puffer cylinder 6. The transfer of PTFE can be confirmed from a contact angle indicating a range of 100 to 110 degrees upon dripping down water drops. The microscopic asperities as well as the depression, in the pit-like shape, formed on the surface, caused the respective wearings 11, and 12 to wear in the initial stage to thereby hold the abrasion-powders thereof, resulting in enhancement in the wear resistance of the puffer cylinder 6 formed of aluminum alloy.

With Comparative Example 1, treatment time was short, and a sufficient hydrated oxide coat of aluminum could not be made, so that an aluminum oxide coat on the surface after heating, as well, was insufficient, thereby having caused the puffer cylinder to be worn, and the wearings as well to be worn by the agency of the abrasion-powders of aluminum.

The non-treated aluminum alloy of Comparative Example 2, as well, was found more worn as compared with the case of Comparative Example 1. The wearings as well were found worn.

Thus, if hydrated hydrated oxide coat of aluminum formed on the surface of an aluminum alloy is heated to thereby remove only the water content of a hydrate, while leaving microscopic asperities as well as a depression, in the pit-like shape, on the surface, as they are, the wear resistance of the puffer cylinder 6 formed of aluminum alloy will be enhanced as compared with the case of non-treated aluminum, so that wear-resistance equivalent to that, in the respective cases of the alumite treatment, and electroless Ni—P plating, is shown under operation conditions of the puffer-type gas circuit breaker according to the invention, and treatment for coat-forming, and liquid waste disposal can be carried out with the use of simple facilities as compared with the case of using the alumite treatment, etc.

While the various embodiments of the invention have been described as above, it is to be understood that the invention be not limited thereto, and that variations thereto be included in the invention. For example, detailed explanation is given about the embodiments described as above simply for the sake of clarity, and therefore, the invention is not necessarily limited to the respective embodiments having all configurations as described. Further, a part of the configuration of one of the embodiments described as above may be replaced with a part of the other embodiment. Still further, the configuration of the other embodiment may be added to the configuration of one of the embodiments. Furthermore, addition, deletion, or replacement by use of other configuration may be made to a part of the configuration with respect to the respective embodiments.

REFERENCE SIGNS LIST

1 . . . stationary-side arc-contactor, 2 . . . stationary-side main contactor, 3 . . . insulation nozzle, 4 . . . movable-side main contactor, 5 . . . movable-side arc-contactor, 6 . . . puffer cylinder, 7 . . . cylinder shaft, 8 . . . external current collector, 10 . . . piston, 11, 12 . . . wearing, 13 . . . puffer chamber, 14 . . . insulation-manipulation rod, 17 . . . whole of a puffer cylinder, 18 . . . link, 20 . . . projection, 21 . . . depression, 22 . . . hydrated a coat, 30 . . . test apparatus, 31 . . . pin-shaped test-piece, 32 . . . cover, 33 . . . disk test-piece, 34 . . . press-down load, 35 . . . rotation axis, 36 . . . through-hole, 37 . . . gas flow (nitrogen gas flow), 60 . . . bearing, 61 . . . casing, 62 . . . shaft, 63 . . . protective cover, 64 . . . through-hole, 65 . . . gas flow

What is claimed is:

1. A puffer cylinder formed of pure aluminum or an aluminum alloy being linked with a movable contactor which is arranged capable of contacting with and separating from a stationary contactor, fitted with a piston inside thereof, and the piston slidably moving against an inner-wall surface of the puffer cylinder in order for the piston to suck in, or spurt an arc-extinguishable gas, the puffer cylinder comprising:

a projection, and a depression in a pit-like shape formed at least on the inner-wall surface of the puffer cylinder; and a coat including a dehydrate of a hydrated oxide of aluminum, the coat being formed on the projection, and the depression in a pit-like shape of the puffer cylinder.

2. The puffer cylinder according to claim 1, wherein the coat is obtained by a chemical conversion coating.

3. The puffer cylinder according to claim 1, wherein the coat has fine asperity structure which is finer than the projection, and the depression in a pit-like shape of the puffer cylinder.

4. The puffer cylinder according to claim 1, wherein the inner-wall surface of the puffer cylinder has surface roughness having skewness (Sk) of a negative value and a depth of the depression in a pit-like shape of 1 μm or more.

5. The puffer cylinder according to claim 1, wherein a wearing is provided on the outer periphery of the piston, and the wearing slidably moves against the inner-wall surface of the puffer cylinder.

6. The puffer cylinder according to claim 4, wherein a wearing is provided on the outer periphery of the piston, and the wearing slidably moves against the inner-wall surface of the puffer cylinder.

7. The puffer cylinder according to claim 1, wherein the projection, and the depression in a pit-like shape are formed throughout the whole of the puffer cylinder and the coat is formed on the projection, and the depression in a pit-like shape of the puffer cylinder by a chemical conversion coating.

8. The puffer cylinder according to claim 4, wherein the projection, and the depression in a pit-like shape are formed throughout the whole of the puffer cylinder and the coat is formed on the projection, and the depression in a pit-like shape of the puffer cylinder by a chemical conversion coating.

9. The puffer cylinder according to claim 5, wherein the projection, and the depression in a pit-like shape are formed throughout the whole of the puffer cylinder and the coat is formed on the projection, and the depression in a pit-like shape of the puffer cylinder by a chemical conversion coating.

10. A puffer-type gas circuit breaker comprising:

a stationary contactor;

a movable contactor being arranged capable of contacting with and separating from the stationary contactor;

a puffer cylinder being formed of pure aluminum or an aluminum alloy, the puffer cylinder being linked with the movable contactor;

a piston for sucking in or spurting an arc-extinguishable gas while making a relative movement against an inner-wall surface of the puffer cylinder; and a vessel being filled up with the arc-extinguishable gas, the vessel housing the stationary contactor, the movable contactor, the puffer cylinder and the piston;

wherein the puffer-type gas circuit breaker is configured such that the arc-extinguishable gas that is spurted as a result of the movement made by the piston is sprayed to an arc caused by a separation of the stationary contactor and the movable contactor to thereby extinguish the arc, and the puffer cylinder is the puffer cylinder described in claim 1.

11. A puffer-type gas circuit breaker comprising:

a stationary contactor;

a movable contactor being arranged capable of contacting with and separating from the stationary contactor, a puffer cylinder formed of pure aluminum or an aluminum alloy, the puffer cylinder being linked with the movable contactor;

a piston for sucking in or spurting an arc-extinguishable gas while making a relative movement against an inner-wall surface of the puffer cylinder;

a vessel being filled up with the arc-extinguishable gas, the vessel housing the stationary contactor, the movable contactor, the puffer cylinder and the piston;

wherein the puffer-type gas circuit breaker is configured such that the arc-extinguishable gas that is spurted as a result of the movement made by the piston is sprayed to an arc caused by the separation of the stationary contactor and the movable contactor to thereby extinguish the arc, and the puffer cylinder is the puffer cylinder described in claim 1.

12. A puffer-type gas circuit breaker comprising:

a stationary contactor;

a movable contactor being arranged capable of contacting with and separating from the stationary contactor;

a piston for sucking in or spurting an arc-extinguishable gas while making a relative movement against an inner-wall surface of the puffer cylinder;

a vessel being filled up with the arc-extinguishable gas, the vessel housing the stationary contactor, the movable contactor, the puffer cylinder and the piston;

wherein the puffer-type gas circuit breaker is configured such that the arc-extinguishable gas that is spurted as a result of the movement made by the piston is sprayed to an arc caused by the separation of the stationary contactor and the movable contactor to thereby extinguish the arc, and the puffer cylinder is the puffer cylinder described in claim 4.

13. A puffer-type gas circuit breaker comprising:

a stationary contactor;

a movable contactor being arranged capable of contacting with and separating from the stationary contactor;

a puffer cylinder being formed of pure aluminum or an aluminum alloy, the puffer cylinder being linked with the movable contactor;

a piston for sucking in or spurting an arc-extinguishable gas while making a relative movement against an inner-wall surface of the puffer cylinder;

a vessel being filled up with the arc-extinguishable gas, the vessel housing the stationary contactor, the movable contactor, the puffer cylinder and the piston;

wherein the puffer-type gas circuit breaker is configured such that the arc-extinguishable gas that is spurted as a result of the movement made by the piston is sprayed to an arc caused by the separation of the stationary contactor and the movable contactor to thereby extinguish the arc, and the puffer cylinder is the puffer cylinder described in claim 5.

14. A puffer-type gas circuit breaker comprising:

a stationary contactor;

a movable contactor being arranged capable of contacting with and separating from the stationary contactor;

a puffer cylinder being formed of pure aluminum or an aluminum alloy, the puffer cylinder being linked with the movable contactor;

a piston for sucking in or spurting an arc-extinguishable gas while making a relative movement against an inner-wall surface of the puffer cylinder;

a vessel being filled up with the arc-extinguishable gas, the vessel housing the stationary contactor, the movable contactor, the puffer cylinder and the piston;

wherein the puffer-type gas circuit breaker is configured such that the arc-extinguishable gas that is spurted as a result of the movement made by the piston is sprayed to an arc caused by the separation of the stationary contactor and the movable contactor to thereby extinguish the arc, and the puffer cylinder is the puffer cylinder described in claim 6.

* * * * *